US005412447A

United States Patent [19]

Earle

[11] Patent Number: 5,412,447

[45] Date of Patent: May 2, 1995

[54] PHOTOGRAPHIC PROCESSING APPARATUS

[75] Inventor: Anthony Earle, Harrow Weald

[73] Assignee: Eastman Kodak Company, Rochester, N.Y.

[21] Appl. No.: 184,158

[22] Filed: Jan. 21, 1994

[51] Int. Cl.[6] ..... G03D 3/08

[52] U.S. Cl. ..... 354/319; 354/320; 354/323

[58] Field of Search ..... 354/313, 316–323, 354/339, 343–345; 226/91–93, 170–173

[56] References Cited

U.S. PATENT DOCUMENTS

| | | | |
|---|---|---|---|
| 3,462,054 | 3/1967 | Foor | 226/91 |
| 4,110,774 | 8/1978 | Krehbiel et al. | 354/345 |
| 4,239,367 | 12/1980 | Hope et al. | 354/319 |
| 4,403,846 | 9/1983 | Osegowitsch et al. | 354/321 X |
| 4,491,503 | 1/1985 | Adams et al. | 226/92 X |
| 4,613,221 | 9/1986 | Takase et al. | 354/321 |
| 4,641,939 | 2/1987 | Kitner | 354/321 X |
| 5,027,146 | 6/1991 | Manico et al. | 354/319 |
| 5,060,009 | 10/1991 | Milovanovich | 355/27 |

FOREIGN PATENT DOCUMENTS

| | | |
|---|---|---|
| 7802906 | 12/1979 | Brazil . |
| 2568024B01 | 7/1984 | France . |
| 2603393A1 | 9/1986 | France . |
| 2739542C2 | 5/1987 | Germany . |
| 2067551 | 3/1990 | Japan . |
| 2067553 | 3/1990 | Japan . |
| 1357911 | 6/1974 | United Kingdom . |
| 1364869 | 8/1974 | United Kingdom . |
| 461403 | 3/1975 | U.S.S.R. . |

*Primary Examiner*—D. Rutledge
*Attorney, Agent, or Firm*—Frank Pincelli

[57] ABSTRACT

It is known to use continuous belts for transporting photographic material through large multi-stranded photographic processing machines so that the material is pulled and guided through each of the processing stages in the machine. The belt is arranged to run on one side of the material path and special spring clips are used to attach the material to the belt. However, the spring clips tend to damage the belt and reduce its operational life. Described herein is a belt arrangement for which clips are not required. A continuous belt (60) having a plurality of slots (68) formed therein is arranged to travel in the material processing path, the belt extending across substantially the entire width of the processing path. Material (70, 72) to be processed is threaded through one of the slots (68) in the belt (60) and folded over. This belt arrangement allows unstable chemistries, such as redox amplification chemistry, to be used in large processing machines by reducing the volumes of processing solutions required.

6 Claims, 3 Drawing Sheets

PHOTOGRAPHIC PROCESSING APPARATUS

FIELD OF INVENTION

This invention relates to photographic processing apparatus and is more particularly concerned with multi-stranded processing apparatus using redox amplification chemistry.

BACKGROUND OF THE INVENTION

Large multi-stranded photographic processing machines are not normally self-threading. A leading edge of the material to be processed has to be pulled and guided through each of the processing stages in the machine. This is normally accomplished by running a continuous belt around the machine to provide a processing path along which the material to be processed is towed. The belt is arranged to run on one side of the processing path. Special spring clips are connected to the belt to which the material is attached. Each clip carries an arm to which the leading edge of the material to be processed is secured for towing through the various processing tanks. After the material has been taken through the processing tanks by the continuous belt, it is detached from the arm and joined on to a take-up spool.

PROBLEMS TO BE SOLVED BY THE INVENTION

This arrangement for towing material through the processing machine is not entirely satisfactory. In very wide processing machines, more than one belt is required. Furthermore, the spring clips tend to damage the belt and reduce its operational life. In particular, where more than one piece material is being processed at the same time, if a piece further away from the belt comes out of the machine before a piece which is nearer or adjacent the belt, a new piece of material cannot be added to the belt. This is because the arm of the clip needs to reach across the piece already in position, and the material across which the arm is to extend may be damaged or torn by the arm.

Moreover, multi-stranded processing machines require large amounts of processing chemistry which make them unsuitable for used with redox amplification processes. In particular, due to the instability of the chemistry involved, it is necessary to reduce the volume of the processing solutions as the rate of chemical usage is not solely dependent on the development of the silver in the material. The chemistry can be self-consuming, and therefore require an increased replenishment rate to overcome this decay.

In known multi-stranded processing machines, processing tank volumes cannot be reduced sufficiently to enable redox amplification processes to be utilized due to having to allow for the belt and the clip carrying arms in the tanks.

SUMMARY OF THE INVENTION

It is therefore an object of the present invention to provide a belt arrangement for use in multi-stranded processing machines which overcomes the problems mentioned above.

In accordance with one aspect of the present invention, there is provided photographic processing apparatus comprising a plurality of processing tanks, each tank containing processing solution, and a transport belt for transporting material to be processed along a processing path through each of the processing tanks, characterized in that the transport belt moves along the processing path and in that the belt has a width which is substantially the same as the processing path.

By this arrangement, a single belt which is positioned to travel along the processing path through the processing tanks and which extends the full width of the processing path, enables smaller volumes of processing solutions to be used and as a consequence makes a large multi-stranded processing machine suitable for use with unstable chemistries, in particular, redox amplification chemistry.

For a better understanding of the present invention, reference will now be made, by way of example only, to the accompanying drawings in which:

DETAILED DESCRIPTION OF THE INVENTION

Figure 1:
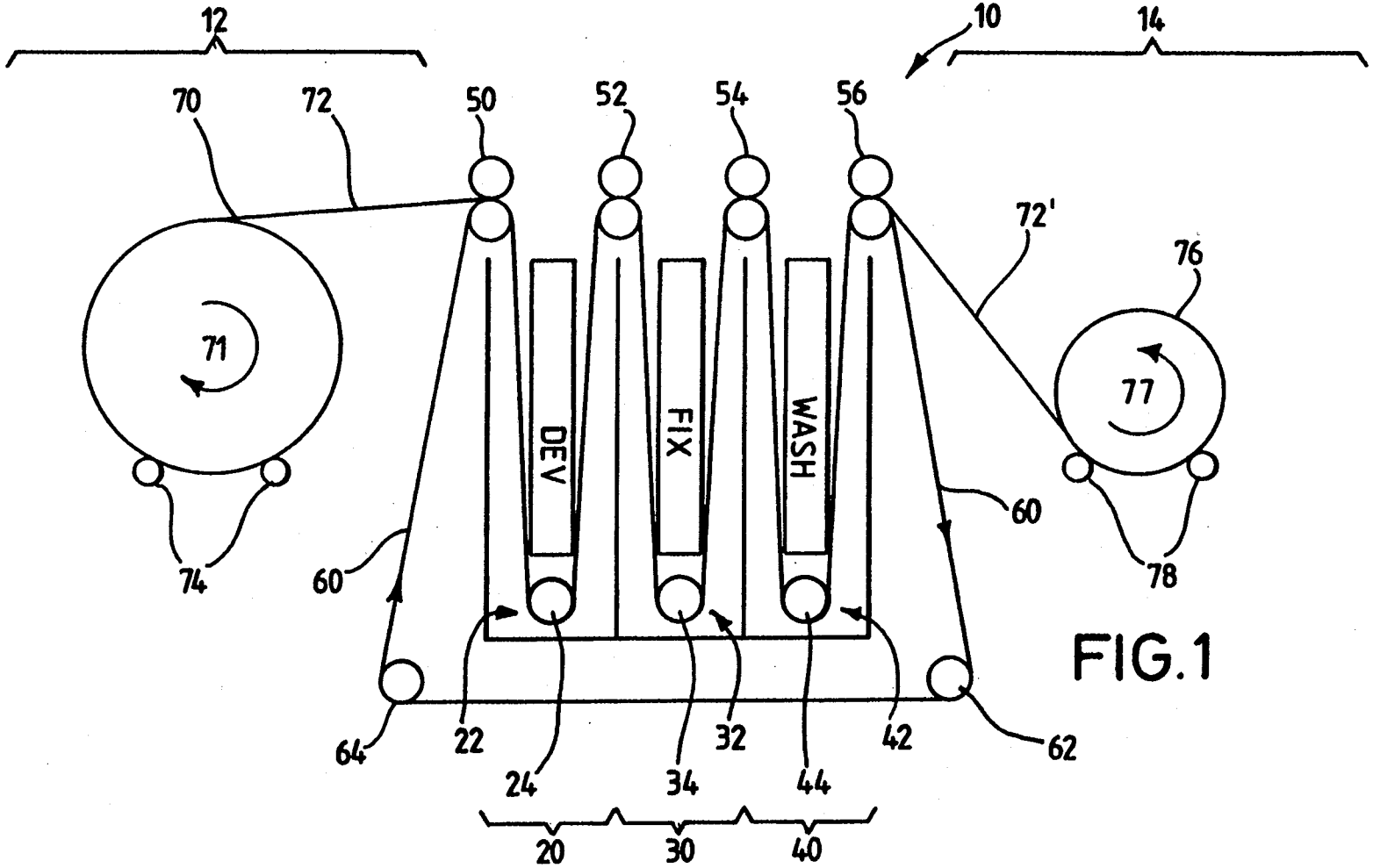
FIG. 1 shows a schematic illustration of a photographic processor having three tanks and utilizing a thread-up belt in accordance with the present invention.

Referring to FIG. 1, a photographic processor 10 is shown which comprises three processing stages, namely, a development stage 20, a fixing stage 30 and a wash stage 40. Each processing stage 20, 30, 40 includes a processing tank 22, 32, 42 containing the appropriate processing solution (not shown). Material to be processed is introduced into the processor 10 at a material loading end 12, and retrieved from the processor at a material unloading end 14.

Driven nip roller pairs 50, 52, 54, 56 are provided for guiding material to be processed through each processing tank 22, 32, 42 and the solution contained therein.

Idler rollers 24, 34, 44 are provided in respective ones of the processing tanks 22, 32, 34 to turn the material around at the bottom of each tank as shown.

A thread-up belt 60, in a continuous loop, passes through the processor 10 from the material loading end 12, through the processing tanks 20, 30, 40, out at the material unloading end 14, and back to the material loading end 12 via guide rollers 62, 64.

As shown, nip rollers 50 are positioned at the material loading end 12, and nip rollers 56 at the material unloading end 14, the other two pairs of nip rollers 52, 54 being positioned between the processing stages 20 and 30, and 30 and 40 respectively.

Material to be processed is supplied to the processor 10 as a roll 70 of web material positioned at the material loading end 12. Material 72 from the roll 70 is attached to the thread-up belt 60 prior to passing through nip rollers 50. The roll 70 is supported on a pair of rollers 74 which apply a back tension to the material 72 as it is taken through the processor 10 by the belt 60. The direction of rotation of the roll 70 is indicated by arrow 71.

Once the material has been processed, it exits the processor 10 at the material unloading end 14 and is separated from the belt 60, as indicated by 72'. The processed material 72' is then wound on to a roll 76 driven by rollers 78 as shown. The direction of rotation of the roll 76 is indicated by arrow 77.

Figure 2:
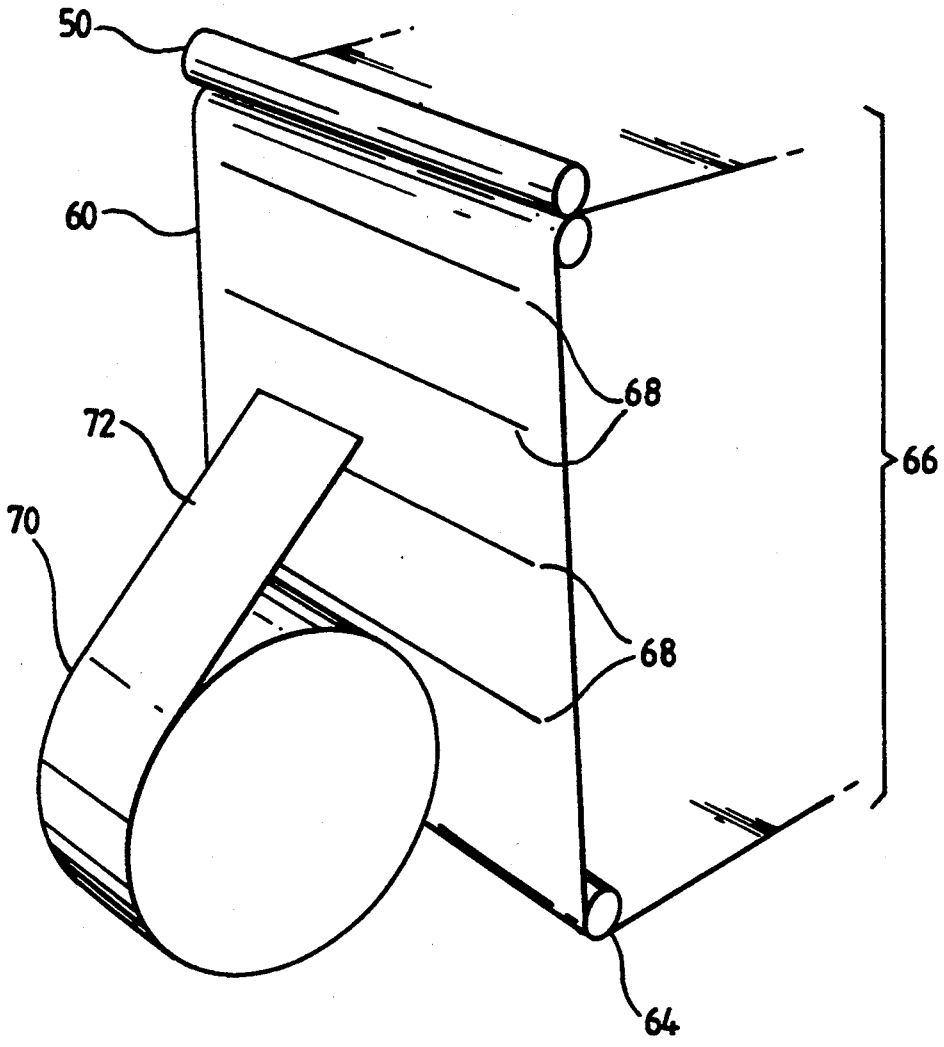
FIG. 2 is a detailed view of the thread-up belt at a loading station.

In FIG. 2, attachment of the material 72 to the belt 60 is shown in more detail. Parts already described are referenced the same. The material loading end 12 of the processor 10 is shown in FIG. 2. Here, a free end of the material 72 is attached to a section 66 of the belt 60 as it rises from roller 64 up to nip rollers 50. A plurality of slots 68 are provided in the belt 60 along its entire length (only four are shown in section 66) through which the material 72 is threaded and attached for transport through the processor 10.

Figure 3:
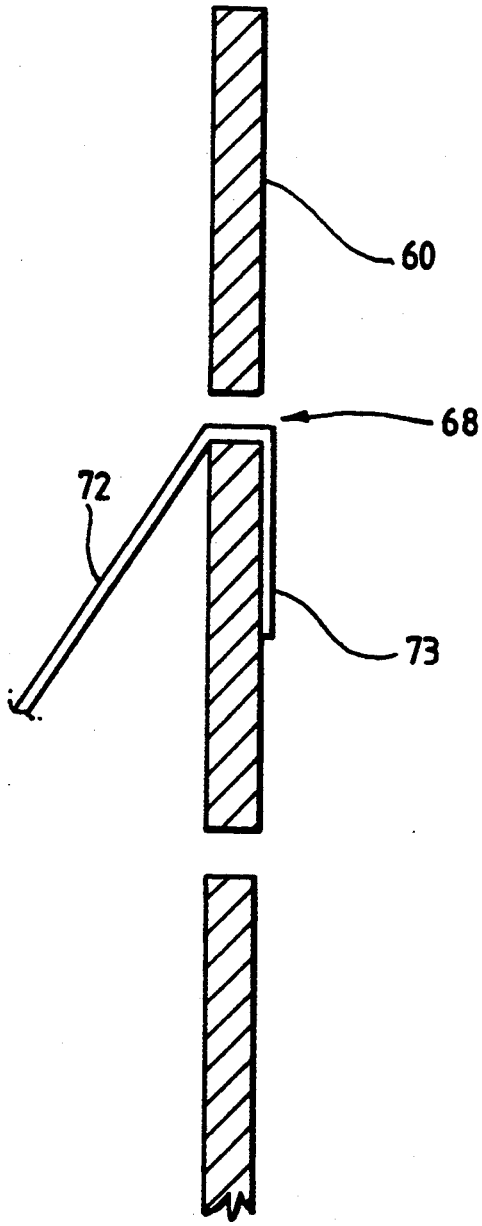
FIGS. 3 and 4 are cross-sectional views illustrating the attachment of the material to be processed to the thread-up belt.
Figure 4:
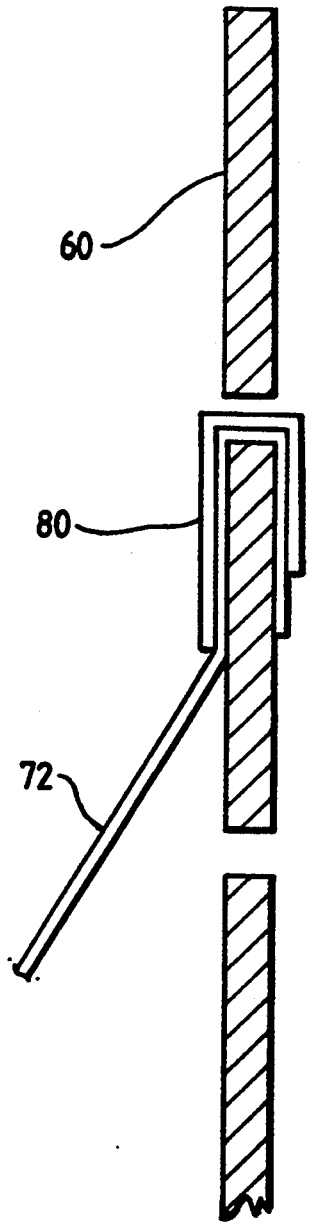

FIGS. 3 and 4 show the section 66 in more detail. As shown in FIG. 3, free end 73 of the material 72 is threaded through a slot 68 in belt 60 and folded over. In some processors, this may be sufficient to retain the material 72 for transport through the various processing stages.

A clip 80, shown in FIG. 4, may be used to attach retain the free end 73 in position in the slot 68 in arrangements where the folded over end is not sufficient to retain the material in position for processing.

ADVANTAGEOUS EFFECTS OF THE INVENTION

The belt arrangement of the present invention has the following advantages:

a) The belt runs directly in the material processing path. This reduces the volume of processing solution required in the processing path and hence enables redox amplification or other unstable chemistries to be used.

b) Tough spring clips associated with the prior art arrangements are not required. This eliminates damage to the belt and hence increases its operational life.

c) The belt forms a moving wall which allows the processing tank thickness to be reduced to a little more than the thickness of the belt and material being processed.

d) Large reductions in tank volumes are obtained.

Furthermore, the belt arrangement of the present invention is not limited to photographic processing apparatus and may be used in any situation where a belt is required to transport material in web form. The present invention can also be used in wet or dry situations.

It is to be noted that although only three tanks are illustrated in the processor shown in FIG. 1, the present invention is applicable to any processor having any number of processing tanks or stages.

What is claimed is:

1. Photographic processing apparatus comprising a plurality of processing tanks, each tank containing processing solution, and a continuous transport belt for transporting material to be processed along a processing path through each of the processing tanks, characterized in that the continuous transport belt moves along the processing path and in that the continuous transport belt has a width which is substantially the same as the processing path.

2. Apparatus according to claim 1, wherein the continuous transport belt is continuous and has a plurality of slots formed therein through which material to be processed is inserted.

3. Apparatus according to claim 2, wherein a clip is used to retain the material in the slot.

4. Apparatus according to claim 1, wherein the processing chemistry is unstable.

5. Apparatus according to claim 2, wherein the processing chemistry is unstable.

6. Apparatus according to claim 3, wherein the processing chemistry is unstable.

* * * * *